US010217589B2

(12) United States Patent
Lang

(10) Patent No.: US 10,217,589 B2
(45) Date of Patent: Feb. 26, 2019

(54) HIGH-SPEED CIRCUIT BREAKING ARRAY FOR BREAKING A CURRENT PATH IN A SWITCHING DEVICE

(71) Applicant: Eaton Electrical IP GmbH & Co. KG, Schoenefeld (DE)

(72) Inventor: Volker Lang, Bonn (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/529,089

(22) PCT Filed: Nov. 24, 2015

(86) PCT No.: PCT/EP2015/077475
§ 371 (c)(1),
(2) Date: May 24, 2017

(87) PCT Pub. No.: WO2016/083359
PCT Pub. Date: Jun. 2, 2016

(65) Prior Publication Data

US 2017/0345595 A1 Nov. 30, 2017

(30) Foreign Application Priority Data

Nov. 28, 2014 (DE) ..... 10 2014 117 489

(51) Int. Cl.
*H01H 71/32* (2006.01)
*H01H 50/32* (2006.01)

(52) U.S. Cl.
CPC ..... *H01H 50/32* (2013.01); *H01H 71/32* (2013.01); *H01H 71/321* (2013.01); *H01H 71/322* (2013.01); *H01H 2050/325* (2013.01)

(58) Field of Classification Search
CPC ..... H01H 71/2454; H01H 71/2463; H01H 71/32; H01H 71/321; H01H 71/322
See application file for complete search history.

(56) References Cited

U.S. PATENT DOCUMENTS 4,307,358 A 12/1981 Haury et al.
6,150,909 A 11/2000 Meier
6,262,648 B1 7/2001 Lammers
(Continued)

FOREIGN PATENT DOCUMENTS

CN 1309812 A 8/2001
CN 201417726 Y 3/2010
(Continued)

*Primary Examiner* — Ramon M Barrera
(74) *Attorney, Agent, or Firm* — Leydig, Voit & Mayer, Ltd.

(57) ABSTRACT

A high-speed circuit breaking array, for breaking a current path in a switching device in the event of a short circuit or overload, has a drive for moving a drive armature from a standby position to a trigger position, wherein the movement of the drive armature is designed to act on at least one movable contact of the switching device in such a way that the current path is broken using a holding device. A switching device having a contact system has at least one fixed contact and at least one movable contact, wherein in order to make and break a current path the movable contact can be reversibly moved in relation to the fixed contact between a make position and a break position using a drive for the purpose of functional switching, and has a high-speed circuit breaking array of this type.

10 Claims, 6 Drawing Sheets

(56) References Cited

U.S. PATENT DOCUMENTS

| | | | |
|---|---|---|---|
| 2004/0027775 | A1 | 2/2004 | Lang |
| 2014/0139964 | A1 | 5/2014 | Reuber et al. |

FOREIGN PATENT DOCUMENTS

| | | | |
|---|---|---|---|
| CN | 101740267 | A | 6/2010 |
| CN | 103703535 | A | 4/2014 |
| DE | 2458874 | B1 | 2/1976 |
| DE | 2848287 | A1 | 5/1979 |
| DE | 19625657 | A1 | 1/1998 |
| DE | 19716380 | C1 | 10/1998 |
| DE | 10140559 | A1 | 2/2003 |
| GB | 2227608 | A | 8/1990 |
| NL | 1008983 | C2 | 10/1999 |
| WO | WO 9750101 | A1 | 12/1997 |
| WO | WO 2014023326 | A1 | 2/2014 |

HIGH-SPEED CIRCUIT BREAKING ARRAY FOR BREAKING A CURRENT PATH IN A SWITCHING DEVICE

CROSS-REFERENCE TO RELATED APPLICATIONS

This application is a U.S. national stage application under 35 U.S.C. § 371 of International Application No. PCT/EP2015/077475, filed on Nov. 24, 2015, and claims benefit to German Patent Application No. DE 10 2014 117 489.5, filed on Nov. 28, 2014. The International application was published in German on Jun. 2, 2016, as WO 2016/083359 A1 under PCT Article 21(2).

FIELD

The invention relates to a high-speed circuit breaker arrangement for interrupting a current path in a switching device in the event of short-circuiting or overload, comprising a drive for moving a drive armature from a standby position into a tripping position.

BACKGROUND

Switching devices of this type comprising corresponding electromagnetic drives are used, for example, in motor starters. These are intended to be suitable for switching a load during operation, for disconnecting an overload and for disconnection in the event of short-circuiting. In principle, in order to achieve this functionality, two separate switching devices, in particular a motor protective switch in the form of a power switch and a protection device in the form of a load switch can also be used. Alternatively, motor starters are known in which the switching and protective function is integrated in one switching device. These motor starters generally comprise a manually operated mechanical latch for this purpose.

WO 2014/023326 A1 describes a switching device or a drive for a switching device for a compact and remotely operable motor starter, by means of which the load can be switched during operation and the overload and short circuits can be disconnected using just one device. The issue with disconnecting short circuits is the need to open the closed contacts very quickly and permanently so as to ensure reliable quenching of the arc, and to prevent re-generation of the arc and welding of the contacts. For this purpose, the drive comprises a bipolar electromagnetic drive unit having a movable armature and two immovable magnet coils for reversibly moving the armature between two permanently magnetic, stabilized armature positions, in which a moving contact can be moved into the closed position by selectively exciting the first magnet coil, and the moving contact can be moved into the open position within a maximum disconnection time permissible for a short circuit in the current path by selectively exciting the second magnet coil.

Electromagnetic drives used for switching on and off are disadvantageous in that they have a comparatively large moving mass that is required for the switching-on process. However, due to inertia, a drive of this type has a correspondingly long switch-off time. The switch-off times achievable in this way can last for as long as it takes to reliably switch off a short circuit. By contrast, a high-speed circuit breaker that is independent of the drive for switching during operation is only provided for interrupting a current path in a switching device in the event of short-circuiting or overload. The high-speed circuit breaker comprises, for example, an electromagnetic drive having a drive armature and a drive coil, the movement of the drive armature being intended to act either directly or indirectly on a moving contact of the switching device so that the current path is interrupted. In the event of short-circuiting, the moving contact is first raised by the electrodynamic effect. The resultant arc is quenched by a suitable arc-quenching apparatus. Before the moving contact opened in this way can fall back and re-close the current path, the high-speed circuit breaker moves the moving contact further towards its open position. In order to react to the short circuit very quickly, the drive coil of the high-speed circuit breaker is excited by the short-circuit current. This current quickly decreases again once the contacts have opened, and therefore permanent opening of the pair of contacts is not ensured by the high-speed circuit breaker.

SUMMARY

An aspect of the invention provides a high-speed circuit breaker arrangement for interrupting a current path in a switching device in the event of short-circuiting or overload, the arrangement comprising: a drive configured to move a drive armature from a standby position into a tripping position, the movement of the drive armature being configured to act on at least one moving contact of the switching device such that a current path is interrupted; a holding apparatus configured to hold the drive armature the tripping position, wherein the holding apparatus includes a holding armature, rigidly coupled to the drive armature, and a magnet arrangement, wherein the holding armature is held in a holding position by a magnetic force of the magnet arrangement as soon as the drive armature reaches the tripping position, and wherein the high-speed circuit breaker arrangement is configured solely for interrupting the current path in the switching device in the event of short-circuiting or overload, and is independent of a drive configured to switch the switching device during operation.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
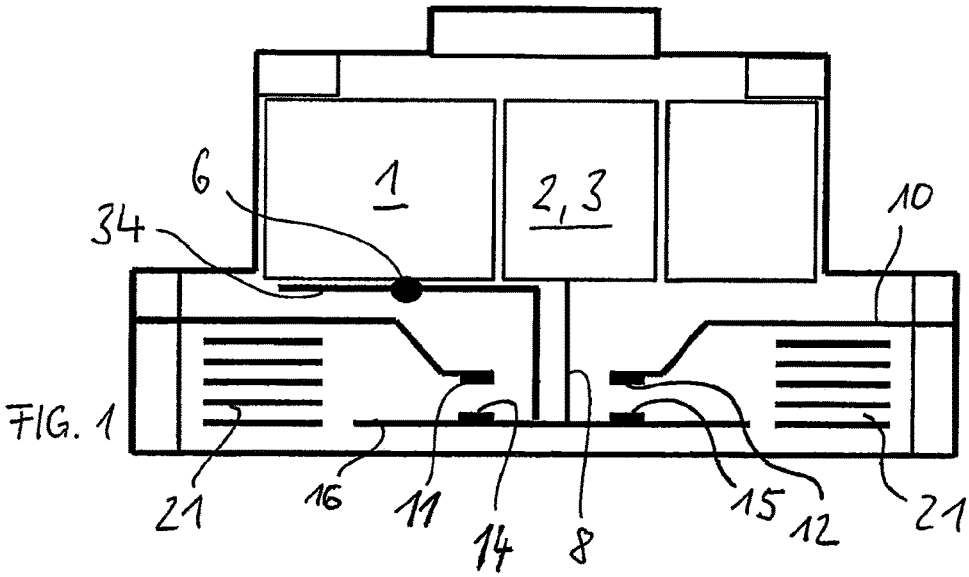
FIG. 1 a schematic view of a switching device comprising a high-speed circuit breaker arrangement.

The invention relates to a high-speed circuit breaker arrangement for interrupting a current path in a switching device in the event of short-circuiting or overload, comprising a drive for moving a drive armature from a standby position into a tripping position, the drive armature being intended to act on at least one moving contact of the switching device such that the current path is interrupted, a holding apparatus being provided for holding the drive armature in the tripping position, and to a switching device comprising a contact system made up of at least one fixed contact and at least one moving contact, the moving contact being reversibly movable, relative to the fixed contact, between a closed position and an open position by means of a drive for switching during operation, in order to close and interrupt a current path.

An aspect of the invention provides a high-speed circuit breaker arrangement for interrupting a current path in a switching device, which arrangement allows for short circuits and/or overloads to be rapidly and permanently disconnected.

The high-speed circuit breaker arrangement according to an aspect of the invention for interrupting a current path in a switching device in the event of short-circuiting or overload comprises a drive for moving a drive armature from a standby position into a tripping position, the drive armature being intended to act on a moving contact of the switching device such that the current path is interrupted. Furthermore, according to the invention, a holding apparatus is provided for holding the drive armature in the tripping position. This prevents the opened moving contact from falling back, even as the excitation current of the drive reduces, which drive is provided as an electromagnetic drive comprising a drive armature and a drive coil, so as to advantageously prevent re-generation of the arc and/or welding of the pair of contacts.

Within the context of an aspect of the invention, the "drive armature acting on the moving contact" should be understood to mean any direct or indirect mechanical application of force suitable for interrupting the moving contact from its associated fixed contact and/or for moving it, in order to increase the distance between the pair of contacts. For this purpose, the drive armature can move an actuator in particular, for example in the form of an impact fork, in order to transmit a drive force either directly or indirectly from the drive armature to the moving contact or to the moving contact via a moving contact carrier. A contact system of the switching device can comprise one or more moving contacts and is preferably designed as a double-break contact system, in which two moving contacts are connected in particular by means of one moving contact carrier in order to be movable relative to two fixed contacts of the current path. Insofar as the following discusses the "drive armature acting on the moving contact", this is to be understood within the context of the invention in that the drive armature acts on one moving contact or on a plurality of moving contacts, depending on the design of the switching device, the variants of which are familiar to a person skilled in the art, even without being expressly mentioned.

According to a first variant of the high-speed circuit breaker arrangement of the invention, the holding apparatus comprises a holding armature that is rigidly coupled to the drive armature, and a magnet arrangement, the holding armature being held in a holding position by a magnetic force of the magnet arrangement as soon as the drive armature reaches the tripping position. The magnet arrangement particularly preferably comprises a coil. Alternatively or additionally, the magnet arrangement particularly preferably comprises a permanently magnetic system.

According to a preferred variant of the magnet arrangement, which comprises a coil but does not comprise a permanently magnetic system, an electromagnetic force of the coil that is separately supplied with current holds the holding armature in the holding position. The holding armature can thus be released in particular by disconnecting the coil, so that the high-speed circuit breaker arrangement can be moved back into the standby position in an advantageously simple manner, for example by a spring that pre-stresses the drive armature towards the standby position.

According to another preferred variant, the magnet arrangement comprises a permanently magnetic system for holding the holding armature in the holding position, but does not comprise a coil. In this case, this advantageously simply deigned variant is moved back by the application of a force to the holding armature, which overcomes the magnetic force of the permanently magnetic system. The source of the force required therefor can be external to the high-speed circuit breaker arrangement, for example the force can be generated by a drive for switching the switching device during operation.

According to another preferred variant of the magnet arrangement, both a coil and a permanently magnetic system are provided, the coil being provided for generating an electromagnetic force in order to overcome the magnetic force of the permanently magnetic system and to release the holding armature. This embodiment also advantageously allows the drive armature to be moved back into the standby position in a particularly simple manner.

According to a second variant of the high-speed circuit breaker arrangement of the invention, the holding device comprises a mechanical lock having a locking element that is pre-stressed against the drive armature, the locking element positively locking the drive armature in the tripping position. One advantage of this embodiment is that the holding apparatus acts directly on the drive armature, and therefore the entrained holding armature of the above-described embodiments can be dispensed with, thus particularly advantageously reducing the installation space and/or the weight of the holding apparatus. The locking element particularly preferably latches in a latching recess on the drive armature that has an undercut in order to prevent unintentional unlocking of the latched locking element, for example as a result of vibration or impact. In this case, the locking element can be linearly movable, preferably in a direction perpendicular to the movement direction of the drive armature, in the form of a carriage. Alternatively, the locking element can be rotatably mounted so that the pre-stress is impressed for example at one end of the locking element, while the opposite end is provided for positively engaging in the latching recess.

According to a preferred embodiment of the high-speed circuit breaker arrangement, the locking element comprises an actuation contour, deflection of the locking element over the actuation contour releasing the drive armature for movement back into the standby position. In this case, the locking element is deflected by a force being applied from outside the high-speed circuit breaker arrangement, for example.

According to another preferred embodiment of the high-speed circuit breaker arrangement, the holding apparatus can be moved back by a drive for switching the switching device during operation, so that the drive armature can be move back into the standby position. This particularly preferred embodiment relates to all the above-described embodiments.

Another embodiment of the invention relates to a switching device comprising a contact system consisting of at least one fixed contact and at least one moving contact, the moving contact being reversibly movable, relative to the fixed contact, between a closed position and an open position by means of a drive, in order to close and interrupt a current path. According to the invention, as described previously, one of the two variants of the high-speed circuit breaker arrangement of the invention is provided, the drive armature acting on the moving contact during movement out of the standby position into the tripping position such that the moving contact reaches the open position from the closed position, where it is permanently held by the holding apparatus. The switching device according to the invention for switching on and switching off a current through the current path comprises at least one fixed contact and at least one moving contact, the moving contact being movable relative to the fixed contact in order to close and interrupt the current path. A contact system of this type can comprise just one pair of contacts. Said system is preferably a double-break system, two moving contacts being connected in particular via one moving contact carrier in order to be movable relative to two fixed contacts of the current path. In the following, the terms "moving contact" and "fixed contact" are used without addressing the possibility of an embodiment having a double-break contact system in each case, since this is familiar to a person skilled in the art. In this respect, a moving contact carrier comprising two moving contacts is covered by the term "moving contact".

According to a preferred embodiment of the switching device, the holding apparatus can be moved back by the drive for switching the switch device during operation during a switching-off process. This allows the holding apparatus to be moved back into the starting state in a particularly simple manner and without manual intervention. Within the context of the invention, "moving back" should be understood to mean that the drive armature of the high-speed circuit breaker arrangement is released following tripping of the holding apparatus that takes place beforehand and is moved in particular from the tripping position back into the standby position.

In the holding apparatus having a permanently magnetic system without a coil, a force of the drive for switching during operation is preferably applied to the holding armature during the switching-off process in order to overcome a holding force of the permanently magnetic system.

In the holding apparatus comprising a mechanical lock, the drive for switching during operation preferably deflects an actuation contour during the switching-off process.

The invention will be described in more detail hereinafter on the basis of embodiments, with reference to the accompanying drawings. The embodiments are merely examples and do not limit the general concept of the invention.

FIG. 1 is a simplified, schematic view of a switching device, in which a high-speed circuit breaker arrangement 2 and a drive 1 for switching during operation are arranged in a common housing. The switching device for switching on and switching off a current through a current path 10 comprises two fixed contacts 11, 12 in order to do this, which contacts interact with two moving contacts 14, 15 on a moving contact carrier 16 in order to close and interrupt the current path 10. The electromagnetic drive 1 is used for moving the moving contact carrier 16 during operation between a closed position in which the pairs of contacts 11, 14 and 12, 15 are closed, and an open position (shown here). The high-speed circuit breaker arrangement 2 for interrupting the current path 10 in the event of short-circuiting or overload is also only shown schematically here. Specific features that characterize the high-speed circuit breaker arrangement 2 according to the invention and the switching device according to the invention will be described in more detail with reference to the remaining figures. The drive 1 for switching during operation acts on the moving contact carrier 16 by means of a mechanism, for example, in the form of a rocker 34 (shown schematically) in this case, which rocker is rotatably mounted in a center of rotation 6. If the drive 1 acts on the rocker 34 at a distal end, the moving contact carrier 16 comprising the moving contacts 14, 15 is moved towards the fixed contacts 11, 12 and the current path 10 is thus closed. A drive 3 of the high-speed circuit breaker arrangement 2 acts in the same direction as the drive 1 for switching during operation, for example, but acts on an actuator 8 that transmits the force of the drive 3 directly to the moving contact carrier 16 comprising the moving contacts 14, 15 and thus moves said contacts away from the fixed contacts 11, 12 so that the current path 10 is interrupted. In principle, the drive 3 could also act on the opposite side of the rotational point 6 of the rocker 34; this would, however, cause the inert drive 1 for switching during operation to fall out of the mechanism.

Deactivating short circuits requires very quick and ideally permanent interruption of the moving contacts 14, 15 from the fixed contact 11, 12. In short-circuit currents, switching off is carried out by the high-speed circuit breaker arrangement 2, the moving contacts 14, 15 first being lifted by electrodynamic lifting forces. By separating the moving contacts 14, 15 from the fixed contacts 11, 12, arcs are formed which are each conducted into quenching systems 21. According to the invention, a holding apparatus 20 that is to be described with reference to FIG. 2 to 8 is provided in order to permanently hold the moving contacts 14, 15 open, which contacts are separated by the drive 3, in order to prevent the moving contacts 14, 15 falling back when the excitation current that operates the drive 3 is reduced as a result of the quenching process. This advantageously prevents re-generation of the arcs or even welding of the moving contacts 14, 15 to the fixed contacts 11, 12.

FIG. 2 to 9 each show the current path 10 with the fixed contacts 11, 12 and the moving contacts 14, 15 on the moving contact carrier 16 of the switching device in addition to the high-speed circuit breaker arrangement 2 comprising the holding arrangement 20, said carrier being pre-stressed towards the closed position by a contact pressure spring 5. The electromagnetic drive 1 for switching during operation is not shown in FIG. 2 to 5 for the sake of simplicity. FIG. 6 to 9 show the electromagnetic drive 1, but, for the sake of simplicity, without the mechanism that is provided for switching on and off during operation and transmits the force to the moving contact carrier 16 in order to carry out the switching processes during operation. The construction of a corresponding protective drive 1 is well-known to a person skilled in the art. Identical components of the embodiments described have the same reference numerals and will not be repeated in the following with reference to every figure.

Figure 2:
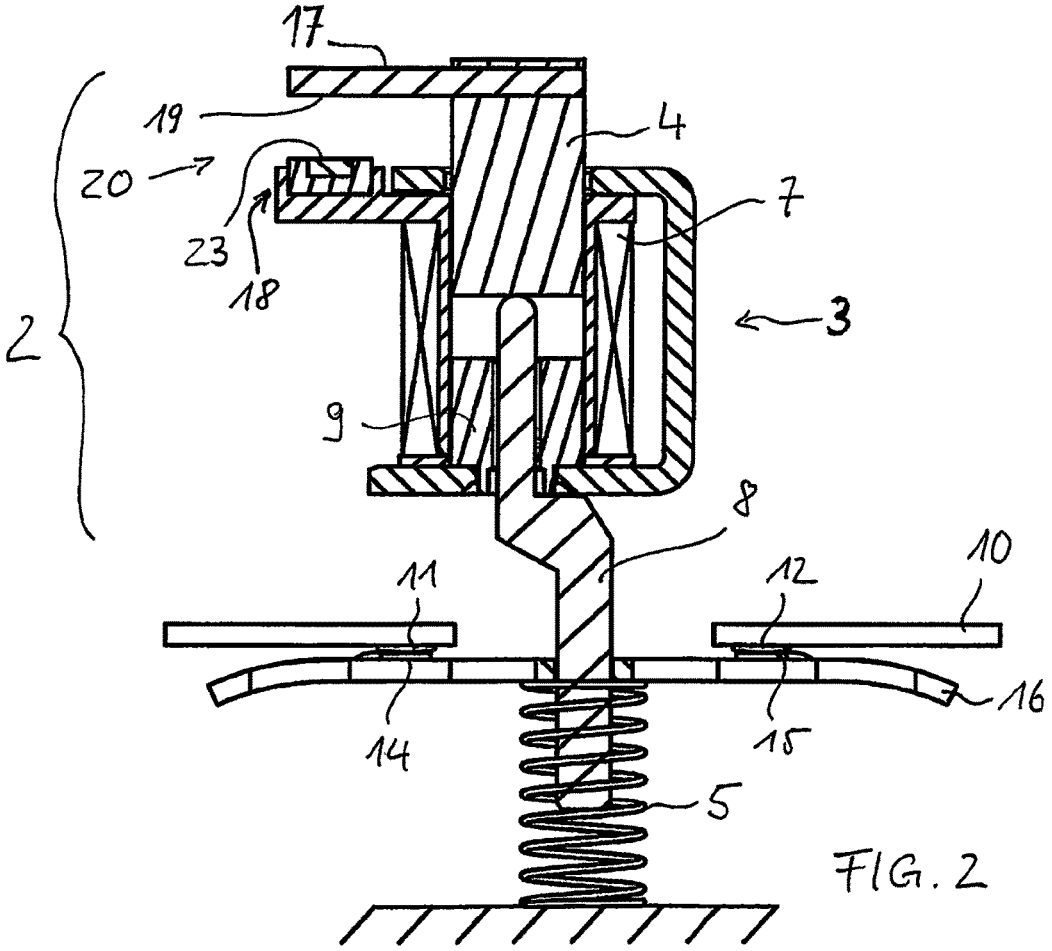
FIG. 2 a detailed view of a portion of a switching device according to the invention with a first embodiment of a high-speed circuit breaker arrangement according to the invention in a standby position.
Figure 3:
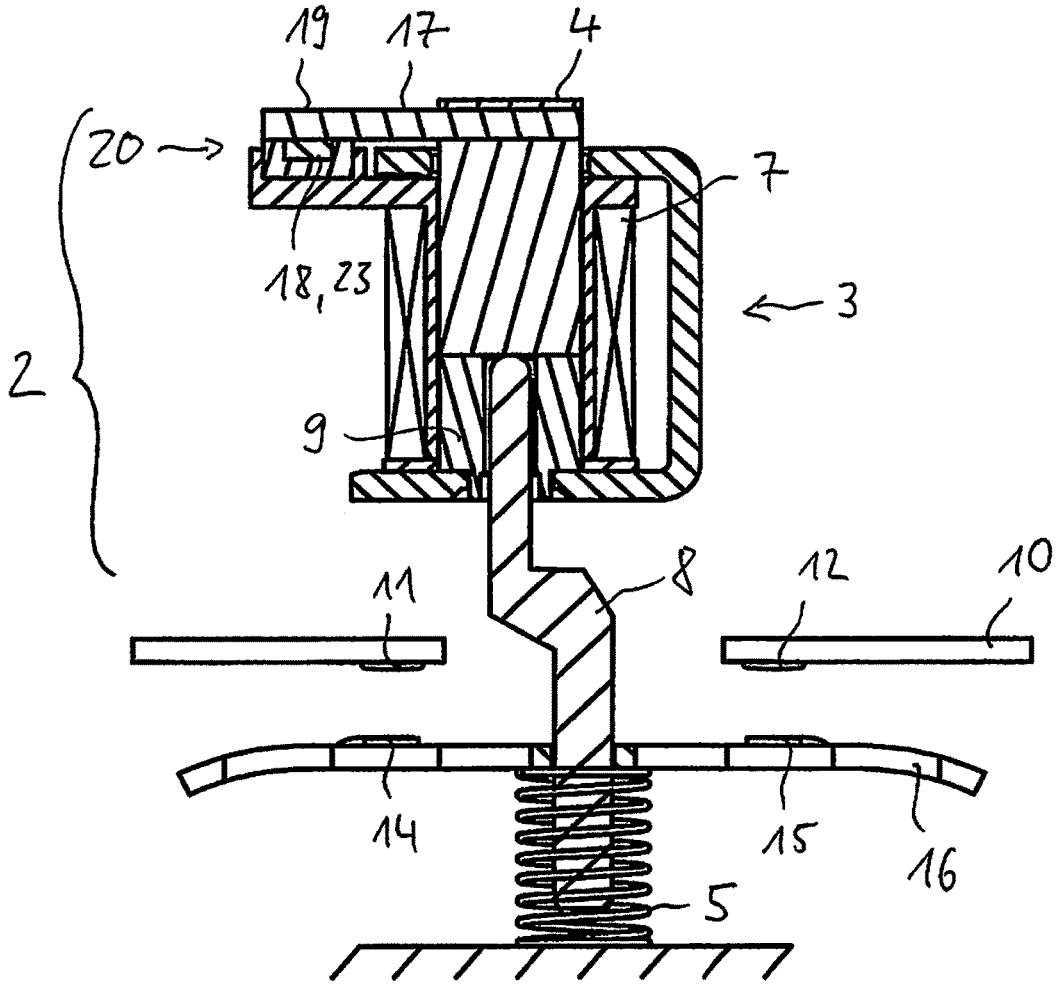
FIG. 3 a detailed view of the portion of the switching device according to FIG. 2 with the first embodiment of the high-speed circuit breaker arrangement in a tripping position.

FIG. 2 is a detailed view of a portion of a switching device according to the invention, with a first embodiment of a high-speed circuit breaker arrangement 2 according to the invention in a standby position, said arrangement being shown in a tripping position in FIG. 3, which is otherwise identical. This means that it is the high-speed circuit breaker arrangement 2, triggered by a short circuit for example, that has separated the current path 10, and not the drive 1 for switching during operation. Either way the moving contacts 14, 15 are therefore in the open position when the triggered high-speed circuit breaker arrangement 2 has been moved into the tripping position according to FIG. 3. For this purpose, the high-speed circuit breaker arrangement 2 comprises the electromagnetic drive 3 having an armature 4 and a magnet coil 7. If an excitation current flows through the magnet coil 7, for example in the event of a short circuit, the armature 4 is operated, said armature acting on the moving contacts 14, 15, which are generally already raised by the electrodynamic lifting forces from the fixed contacts 11, 12, via the actuator 8 and the moving contact carrier 16, and pressing said moving contacts against the force of the contact pressure spring 5 into the open position. In an alternative embodiment, the armature 4 can also act directly on the moving contact carrier 16 or the moving contacts 14, 15. The actuator 8, which is guided through a core 9 of the drive 3 in this case, can be designed as an impact fork. The actuator 8 is generally movable independently of the mechanism in order to transmit the force of the drive 1 for switching during operation.

According to the invention, the high-speed circuit breaker arrangement 2 further comprises a holding apparatus 20 for holding the drive armature 4 in the tripping position. According to one embodiment, the holding apparatus 20 comprises a holding armature 19 that is rigidly coupled to the drive armature 4, and a magnet arrangement 18, the holding armature 19 being held in a holding position shown in FIG. 3 by a magnetic force of the magnet arrangement 18 as soon as the drive armature 4 reaches the tripping position. In the first embodiment of the high-speed circuit breaker arrangement 2 according to FIGS. 2 and 3, the magnet arrangement 18 comprises just one permanently magnetic system 23, and no electromagnets. The holding armature 19 is formed by an end region of an arm 17, which is used as a rigid coupling 17 between the drive armature 4 and the holding armature 19. The holding apparatus 20 can preferably be moved back, during a switching-off process, by the drive 1, shown in FIG. 1, for switching the switching device during operation, for example by the force of the drive 1 for switching during operation acting on the holding armature 19 during the switching-off process in order to overcome a holding force of the permanently magnetic system 23.

Figure 4:
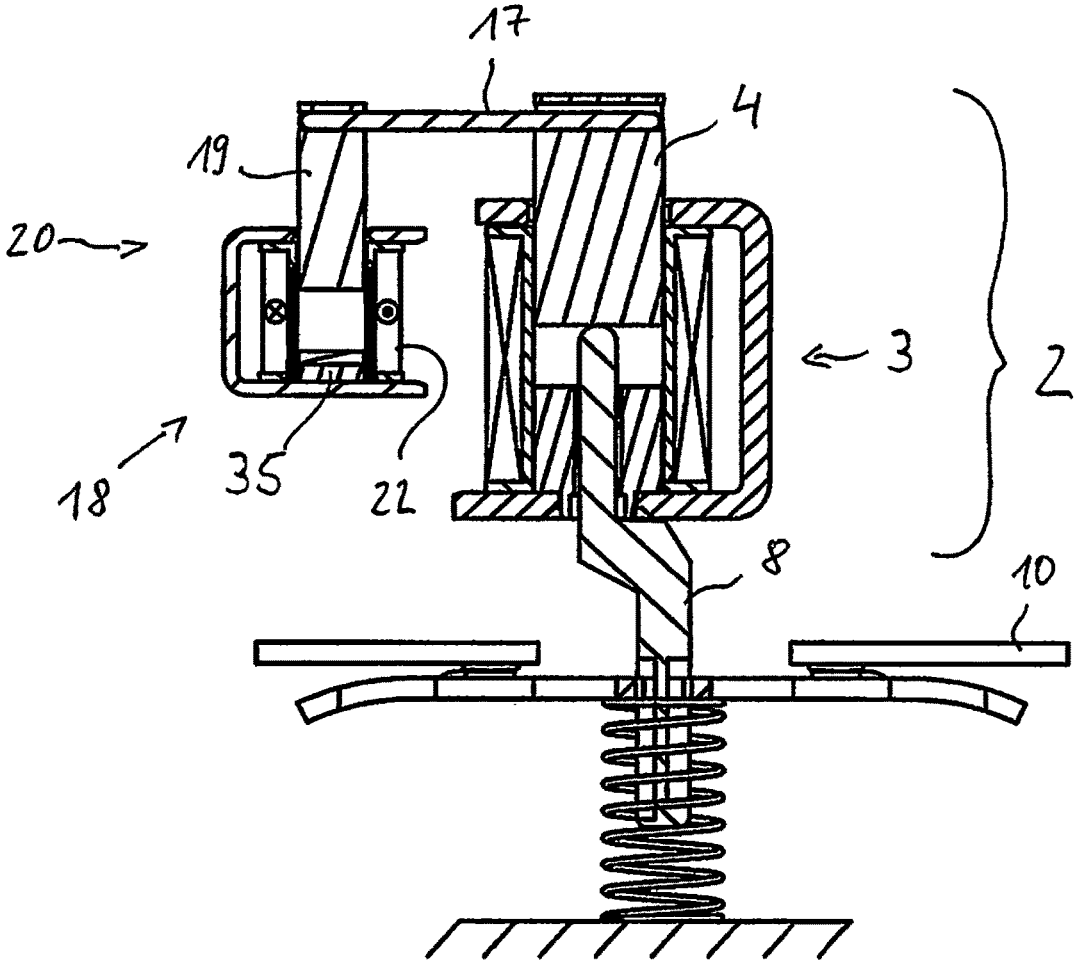
FIG. 4 a detailed view of a portion of a switching device according to the invention with a second embodiment of the high-speed circuit breaker arrangement according to the invention in a standby position.
Figure 5:
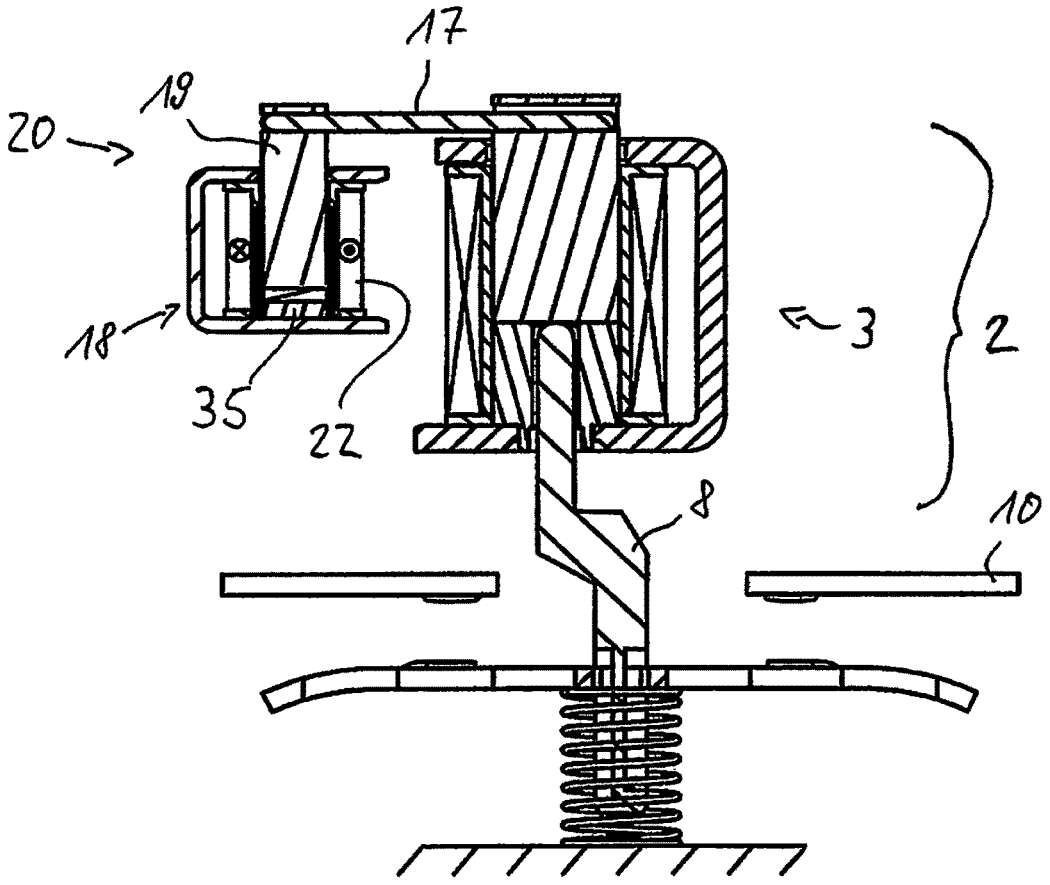
FIG. 5 a detailed view of the portion of the switching device according to FIG. 4 with the second embodiment of the high-speed circuit breaker arrangement in a tripping position.

FIG. 4 shows a detailed view of a portion of a switching device according to the invention, comprising a second embodiment of the high-speed circuit breaker arrangement 2 according to the invention in the standby position, said arrangement being shown in the tripping position in FIG. 5, which is otherwise identical. The second embodiment differs from the first embodiment in that the magnet arrangement 18 comprises a coil 22. The holding armature 19 is fixed to one end of the rigid coupling 17 as a separate component in this case, and is therefore moved at the same time by the drive armature 4. The second embodiment can be formed by two variants of the magnet arrangement 18, both of which are described in connection with FIGS. 4 and 5.

According to one variant, the magnet arrangement 18 comprises the coil 22, but no permanent magnets. The holding armature 19 is therefore held in the holding position by an electromagnetic force of the coil 22. One advantage is that the holding armature 19 is released by disconnecting the coil 22, making it particularly easy to move the high-speed circuit breaker arrangement 2 back into the standby position.

Another variant of the magnet arrangement 18 is that a permanently magnetic system 35 is provided in order to hold the holding armature 19 in the holding position. The coil 22 is provided for generating an electromagnetic force in order to overcome the magnetic force of the permanently magnetic system 35 and to release the holding armature 19.

Once the holding armature 19 has been released, the drive armature 4 returns to its standby position in both variants, thus causing the high-speed circuit breaker arrangement 2 to be moved back and to be ready for use once again. For this, the drive armature 4 can be pre-stressed towards its standby position, for example in a manner not shown. Alternatively, the high-speed circuit breaker arrangement 2 is moved back by the drive 1 for switching during operation.

Figure 6:
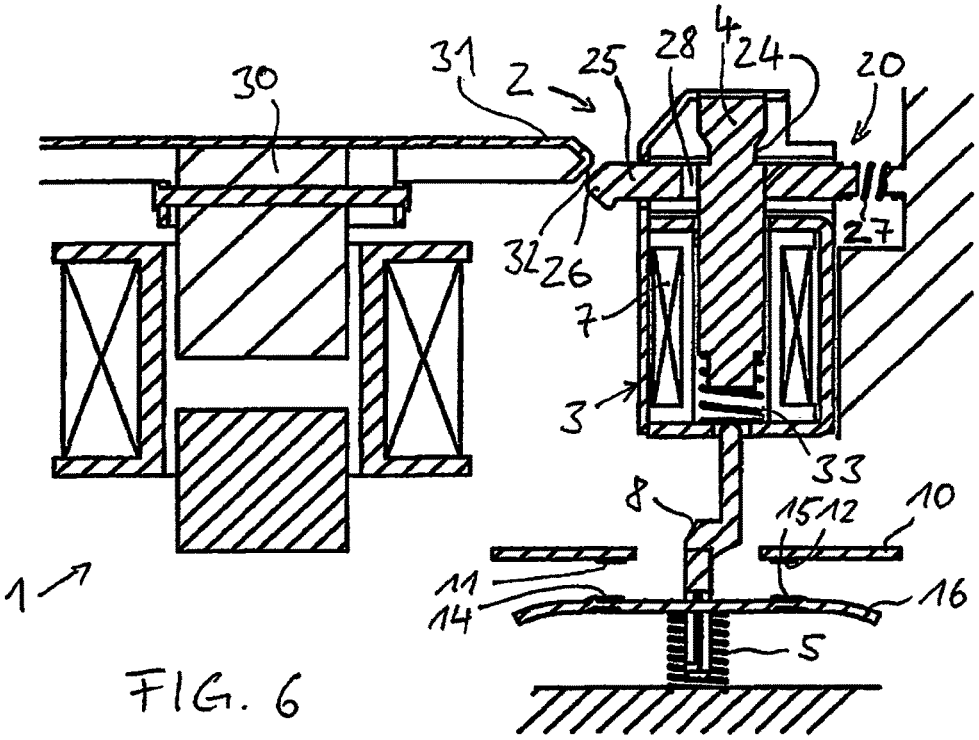
FIG. 6 a detailed view of a portion of a switching device according to the invention in a switched-off state with a third embodiment of the high-speed circuit breaker arrangement according to the invention in a standby position.
Figure 7:
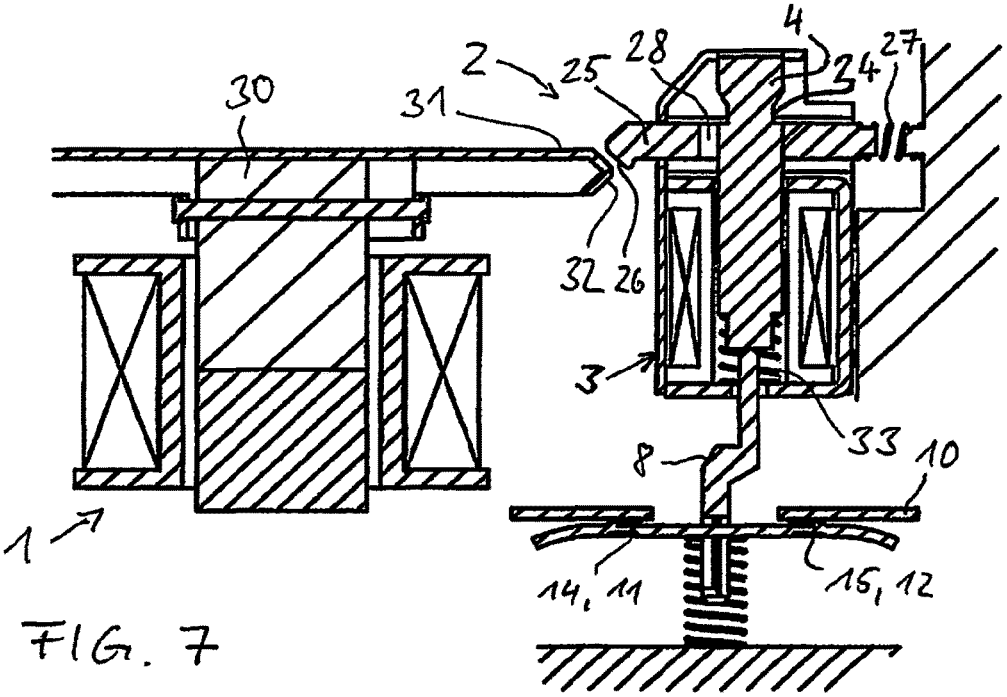
FIG. 7 a detailed view of the portion of the switching device according to FIG. 6 in a switched-on state.
Figure 8:
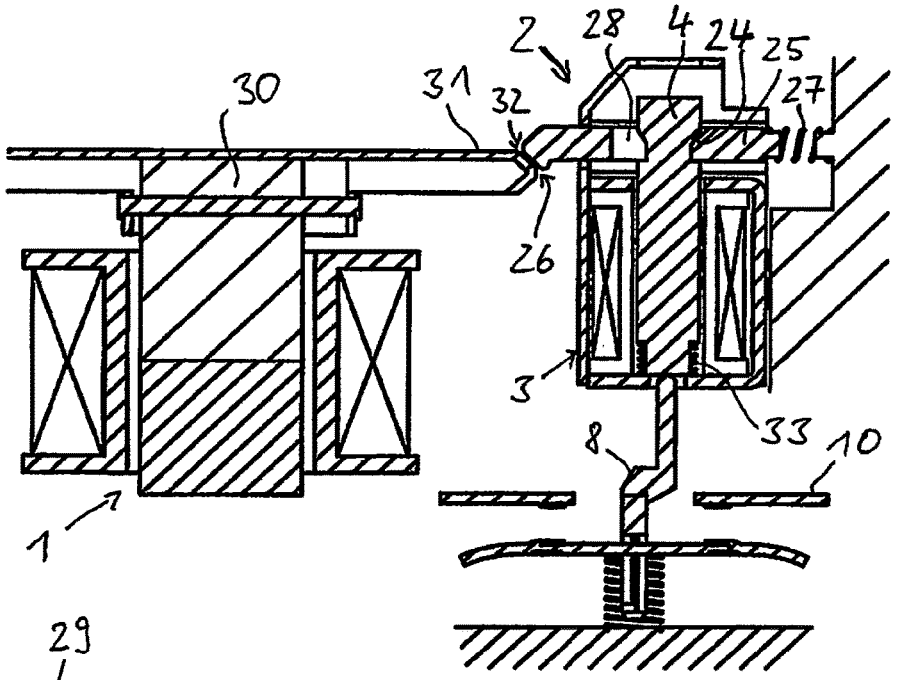
FIG. 8 a detailed view of the portion of the switching device of the invention according to FIG. 6, with the third embodiment of the high-speed circuit breaker arrangement according to the invention in a tripping position.
Figure 10:
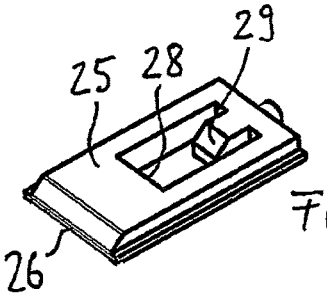
FIG. 10 a detail of the third embodiment of the high-speed circuit breaker arrangement.
Figure 9:
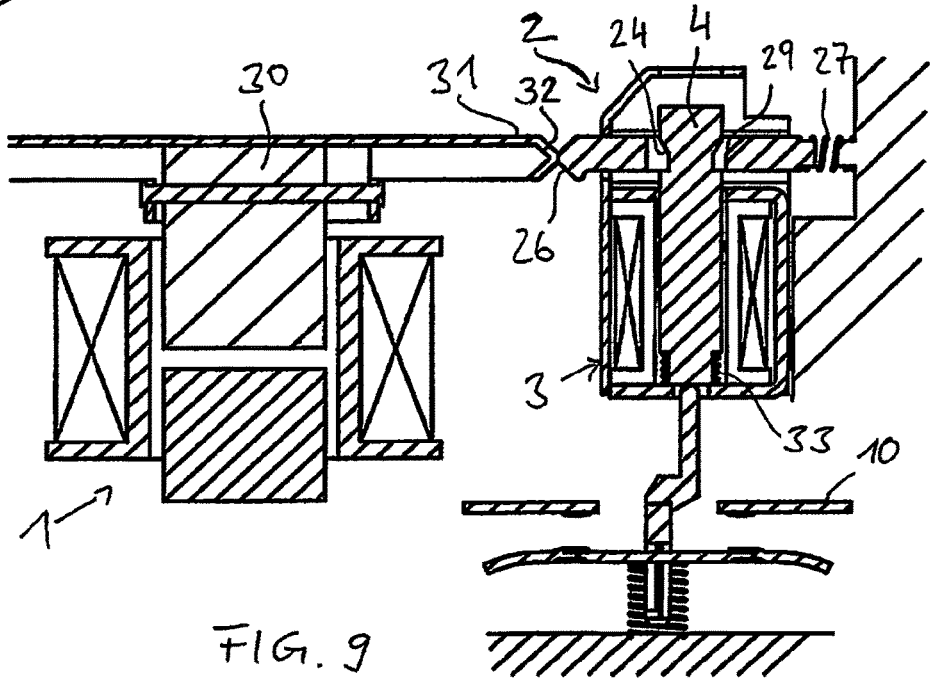
FIG. 9 a detailed view of the portion of the switching device according to FIG. 6 as the third embodiment of the high-speed circuit breaker arrangement moves from the tripping position back into the ready position.

A third embodiment of the high-speed circuit breaker arrangement 2 according to the invention will be described in the following with reference to FIG. 6 to 10. FIG. 6 is a detailed view of a portion of the switching device according to the invention in a switched-off state, with the high-speed circuit breaker arrangement 2 in a standby position. FIG. 7 shows the switching device in a switched-on state. FIG. 8 shows the switching device with the high-speed circuit breaker arrangement 2 in the tripping position. FIG. 9 shows the switching device as the high-speed circuit breaker arrangement 2 moves from the tripping position back into the standby position. For the sake of simplicity, FIG. 6 to 9 show the electromagnetic drive 1 for switching during operation without the mechanism provided for switching on and off, which mechanism can act on the actuator 8, for example, or carries out the switching process independently of said actuator. The drive 1 comprises an armature 30. A person skilled in the art knows that a movement of the armature 30 is correspondingly transmitted to the moving contact carrier 16, for example by a mechanism corresponding to the rocker 34 (FIG. 1), in order to move the moving contacts 14, 15 back and forth between the open position and the closed position when switching during operation.

The third embodiment of the high-speed circuit breaker arrangement 2 differs from the above-described embodiments in that the holding apparatus 20 comprises a mechanical lock for the drive armature 4, which acts directly on the drive armature 4 so that an entrained holding armature is not required. For this purpose, the holding apparatus 20 comprises a locking element 25 for example, which is pre-stressed against the drive armature 4 by means of a pressure spring 27 and is shown in detail in FIG. 10. The locking element 25 comprises an opening 28, through which the drive armature 4 is passed. A detent 29 protrudes into the opening. If, according to FIG. 7, overload or short-circuiting occurs when the current path 10 is closed, the high-speed circuit breaker arrangement 2 is triggered so that the drive armature 4 is operated and moved out of the standby position and into the tripping position and thus presses the moving contacts 14, 15 into the open position by means of the actuator 8, as shown in FIG. 8. When the tripping position is reached, a latching recess 24 in the drive armature 4 reaches the region of the locking element 25, the detent 29 of which (FIG. 10) is then moved into the latching recess 24 by the pre-stress of the pressure spring 27. The locking element 25 thus positively locks the drive armature 4 in the tripping position so as to prevent re-closure of the current path 10, re-generation of the arc and welding of the contacts. In this case, the locking element 25 latches to an undercut of the latching recess 24 in particular in order to prevent unintentional unlocking of the latched locking element 25.

The process of moving back the third embodiment of the high-speed circuit breaker arrangement 2 is described in the following with reference to FIG. 9. An actuating arm 31 is arranged on the armature 30 of the drive 1 for switching during operation, which arm is provided to move the locking element 25 against the application of force of the pressure spring 27, in order to release the lock of the drive armature 4. An impression spring 33 moves the drive armature 4 back into its standby position. The locking element 25 comprises an actuation contour 26 for this purpose, which interacts with a mating contour 32 on the actuating arm 31, which arm is moved, during a switching-off process, together with the armature 30 by the drive 1 for switching during operation. The deflection of the locking element 25 over the actuation contour 26, in which the drive armature 4 is released, is shown in FIG. 9. The third embodiment is thus moved back after the high-speed circuit breaker apparatus 2 has been tripped by a switching-off process by the drive 1 for switching during operation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

1 drive for switching the switching device during operation
2 high-speed circuit breaker arrangement
3 drive for the high-speed circuit breaker arrangement
4 drive armature
5 contact pressure spring
6 center of rotation
7 magnet coil
8 actuator
9 core of the high-speed circuit breaker
10 current path
11 fixed contact
12 fixed contact
14 moving contact
15 moving contact
16 moving contact carrier
17 rigid coupling, arm
18 magnet arrangement
19 holding armature
20 holding apparatus
21 arc-quenching system
22 holding apparatus coil
23 permanently magnetic system
24 latching recess
25 locking element
26 actuation contour
27 pressure spring
28 opening
29 detent
30 armature of the drive for switching the switching device during operation
31 actuating arm
32 mating contour
33 impression spring
34 rocker
35 permanently magnetic system

The invention claimed is:

1. A high-speed circuit breaker arrangement for interrupting a current path in a switching device in the event of short-circuiting or overload, the arrangement comprising:

a drive configured to move a drive armature from a standby position into a tripping position, the movement of the drive armature being configured to act on at least one moving contact of the switching device such that a current path is interrupted;

a holding apparatus configured to hold the drive armature the tripping position, wherein the holding apparatus includes a holding armature, rigidly coupled to the drive armature, and a magnet arrangement, wherein the holding armature is held in a holding position by a magnetic force of the magnet arrangement as soon as the drive armature reaches the tripping position, and wherein the high-speed circuit breaker arrangement is configured solely for interrupting the current path in the switching device in the event of short-circuiting or overload, and is independent of a drive configured to switch the switching device during operation.

2. The high-speed circuit breaker arrangement of claim 1, wherein the magnet arrangement includes a coil.

3. The high-speed circuit breaker arrangement of claim 2, wherein an electromagnetic force of the coil supplied with current holds the holding armature in the holding position.

4. The high-speed circuit breaker arrangement of claim 3, wherein the holding armature can be released by disconnecting the coil.

5. The high-speed circuit breaker arrangement of claim 1, wherein the magnet arrangement includes a permanently magnetic system configured to hold the holding armature in the holding position.

6. The high-speed circuit breaker arrangement of claim 5, wherein a coil is configured to generate an electromagnetic force in order to overcome the magnetic force of the permanently magnetic system and to release the holding armature.

7. The high-speed circuit breaker arrangement of claim 1, wherein the holding apparatus can be moved back by a drive configured to switch the switching device during operation, so that the drive armature can move back into the standby position.

8. A switching device, comprising:

a contact system including the high-speed circuit breaker arrangement of claim 1, wherein the contact system includes a fixed contact and the moving contact, wherein the moving contact is reversibly movable, relative to the fixed contact, between a closed position and an open position in order to close and interrupt the current path by a drive configured to switch during operation.

9. The switching device of claim 8, wherein, during a switching-off process, the holding apparatus can be moved back by the drive configured to switch the switching device during operation.

10. The switching device of claim 9, wherein, in the holding apparatus including a permanently magnetic system, a force of the drive configured to switch during operation is applied to the holding armature during the switching-off process in order to overcome a holding force of the permanently magnetic system.

* * * * *